US008109210B2

(12) United States Patent
Strautmann

(10) Patent No.: US 8,109,210 B2
(45) Date of Patent: Feb. 7, 2012

(54) DEVICE FOR PRODUCING COMPRESSED BALES

(75) Inventor: Wolfgang Strautmann, Bad Laer (DE)

(73) Assignee: SIB Strautmann Ingenieurburo GmbH, Glandorf (DE)

( * ) Notice: Subject to any disclaimer, the term of this patent is extended or adjusted under 35 U.S.C. 154(b) by 209 days.

(21) Appl. No.: 12/530,815

(22) PCT Filed: Mar. 14, 2008

(86) PCT No.: PCT/EP2008/002082

§ 371 (c)(1),
(2), (4) Date: Sep. 11, 2009

(87) PCT Pub. No.: WO2008/113531

PCT Pub. Date: Sep. 25, 2008

(65) Prior Publication Data

US 2010/0095854 A1 Apr. 22, 2010

(30) Foreign Application Priority Data

Mar. 16, 2007 (DE) ..... 10 2007 013 382
Aug. 31, 2007 (DE) ..... 10 2007 041 316

(51) Int. Cl.
*B65B 13/02* (2006.01)
*B30B 9/30* (2006.01)

(52) U.S. Cl. ..... 100/3; 100/179; 100/215; 100/240

(58) Field of Classification Search ..... 100/2, 3, 100/7, 137, 215, 218, 240, 245, 249, 269.01, 100/179

See application file for complete search history.

(56) References Cited

U.S. PATENT DOCUMENTS 3,693,541 A 9/1972 Lombard et al.
4,040,230 A * 8/1977 Pessel et al. ..... 53/438
4,162,603 A 7/1979 Strömberg
RE31,944 E * 7/1985 Stromberg ..... 53/438
4,573,403 A 3/1986 Van Doorn et al.

(Continued)

FOREIGN PATENT DOCUMENTS

DE 2819807 11/1978
DE 202006007759 U1 8/2006
EP 0429798 A1 6/1991

(Continued)

*Primary Examiner* — Jimmy T Nguyen

(74) *Attorney, Agent, or Firm* — Greer, Burns & Crain, Ltd.

(57) ABSTRACT

The invention relates to a device for producing compressed bales from compressible pressed product pieces, each compressed bale produced having a cuboid form with edge lengths A, B and C. The device includes a press housing having at least one press chamber and a press shield that can be moved in the press chamber in the press direction and back by means of a mechanical drive. The press chamber has a cross-sectional surface of A×C/n. In the press chamber, n partial compressed bales can be produced in n first press steps, with a flat cuboid form with the edge lengths A, B and C/n. A storage space is arranged downstream from the press chamber, n partial compressed bales being transferable into the storage space. The partial compressed bales can be joined in the storage space to form the cuboid compressed bales with the edge lengths A, B and C. The press chamber is separated from the storage space by a mobile partition, and an opening-that can be freed by the partition has at least the dimension A×B in the opening position, such that a partial compressed bale formed in the press chamber can be transported into the storage space through the opening.

40 Claims, 10 Drawing Sheets

U.S. PATENT DOCUMENTS

| | | | | | |
|---|---|---|---|---|---|
| 5,001,975 | A | | 3/1991 | Finden | |
| 5,195,429 | A | | 3/1993 | Firpo | |
| 5,687,643 | A | * | 11/1997 | Felts et al. | 100/3 |
| 5,890,426 | A | | 4/1999 | Gumkowski | |

FOREIGN PATENT DOCUMENTS

| | | | |
|---|---|---|---|
| EP | 0677376 | A1 | 10/1995 |
| FR | 2 460 602 | | 1/1981 |
| JP | 10-323798 | | 12/1998 |

* cited by examiner

DEVICE FOR PRODUCING COMPRESSED BALES

BACKGROUND OF THE INVENTION

The present invention relates to a device for producing compressed bales from compressible pressed product pieces, in particular residues, such as used paper, used paper-board containers, plastic films or empty plastic bottles, each compressed bale produced having an essentially cuboid form with edge lengths A, B and C. The device comprises a press housing having at least one press chamber and a press shield that can be moved in the press chamber in the press direction and back by means of a mechanical drive.

Baling presses for the different applications are equipped with a press shield that can be moved either in vertical direction or in horizontal direction and have been known on the market for many years. Usually, the compressed bales produced have a cuboid or cubic form wherein the dimensions of the edge lengths of the compressed bales are, in particular, dependent on the transportation means which are used to transport the compressed bales after the production thereof. If they are to be transported on europallets, the width and depth of the bales are, appropriately, adjusted to the base area of the pallet and will then have a size of approximately 800 mm×1,200 mm. To ensure that the bale remains protected from overturning, its maximum height is approximately 1,200 mm. If the bales are to be transported in containers, a size of the bales that is usual in the market is approximately 1,100 mm×1,100 mm×1,100 mm, i.e. a cubic form. In its dimensions, the press chamber of the presses for producing such compressed bales is designed according to the dimensions of the compressed bales to be produced, and the cross-sectional area of the press chamber will then have dimensions that correspond to the width and depth of the compressed bales.

If presses are equipped with a press shield that can be moved in vertical direction, the press shield is driven either by one or by a plurality of hydraulic cylinders. Known vertical single-chamber baling presses are filled through a fill chamber or a door that closes the entire press chamber and is partially opened during filling. The pressed product pieces to be compressed are inserted below the press shield that is, then, it its uppermost position, through the door opening and into the press chamber and are, if necessary, placed onto pressed product that has already been compressed. Once a filling region of the press chamber is filled such that new pressed product does not fit in any more, the door is closed and the movable press shield moves toward a floor of the press chamber that is limiting the press chamber at its bottom. In order to realize bale weights that are as high as possible, large-dimensioned hydraulic cylinders are used today, said cylinders exerting a large press force onto the pressed product to be compressed to form a compressed bale if the pressure is appropriate.

If baling presses are equipped with a press shield that can be moved in vertical direction, the guide of the press shield in the press chamber presents a problem that cannot be neglected. There are different realized guides of the press shield in the press chamber, but all of these guides were, in practice, not able to prevent the press shield or the hydraulic drive elements (hydraulic cylinders) from being damaged, in particular in case of an irregular filling of the press chamber. A further problem caused in baling presses with a press shield that can be moved in vertical direction is that a desired high-degree compaction of the pressed product, i.e. a high bale density, is only achieved with an appropriately high surface pressure, this being realizable with a given maximum pressure of the hydraulic system only if large-dimensioned hydraulic cylinders are used. Such hydraulic cylinders have a large volume which must be delivered or recirculated by hydraulic pumps within a short time. In order that this can be accomplished within a short cycle time (time elapsing from the beginning to the end of the press cycle, i.e. until the press can be refilled), which is requested by the users of the press, large-dimensioned electric drives for hydraulic pumps are required which, in turn, require a corresponding electrical infrastructure. At some press installation locations, this infrastructure is not available and can be retrofitted with only much effort.

If baling presses are equipped with a press shield that can be moved in horizontal direction, the press chamber is also filled through a lockable press chamber door. Herein, the press chamber is filled while the press shield is in its rear end position. Once the press chamber is filled with sufficient pressed product, so that it is no longer possible to insert further pressed product, the press chamber door is closed and the horizontally movable press shield moves forward and compresses the pressed product in front of the press shield to form a compressed bale. Where presses with a press shield that can be moved in horizontal direction are concerned, the guide of the press shield also presents a frequent source of failures and damage.

In particular, irregular filling or filling with differently compressible pressed product pieces may lead to damage to the guide of the press shield or even to a bending of the piston rod of the hydraulic cylinder, said piston rod driving the press shield. To achieve a desired high-degree compaction, horizontal baling presses also require a high surface pressure to be exerted on the bale surface. This, in turn, requires large-dimensioned hydraulic cylinders. In this respect, the requirements for the design of the electric drives for the hydraulic pumps are comparable in these presses as well.

SUMMARY OF THE INVENTION

The present invention, therefore, aims at creating a device of the aforementioned type which can be used to obviate the drawbacks presented above and to reliably generate compressed bales with a high density, i.e. with a high bale weight at given bale dimensions, in a manner that requires less effort but still yields a high efficiency. Furthermore, the device should be able to be operated reliably and safely as well as with reduced complexity in terms of technical equipment, energy and installation room. Therein, it should be particularly ensured that deformation of the press shield or damage to the mechanical drive and/or the guides of the press shield is prevented. At the same time, it should be possible to achieve short press cycle times and high surface pressures in order to achieve as high a bale density as possible.

This problem is solved by the invention by means of a device of the aforementioned type, which is characterized in that the press chamber has a cross-sectional surface of A×C/n as seen perpendicularly in relation to the press direction, wherein n is greater than or equal to 2 and wherein, in the press chamber, n partial compressed bales can be produced in n first press steps, with a flat cuboid form with the edge lengths A, B and C/n, a storage space is arranged downstream from the press chamber, each compressed bale being transferable into said storage space after its production, until n partial compressed bales bear against each other with their flat sides in the storage space, the n partial compressed bales can each be joined in the storage space to form the cuboid compressed bale with the edge lengths A, B and C by applying at least one joining means, the press chamber is separated from the storage space by a partition that can be moved between a closing position and an opening position, said partition forming a part of a wall of the press chamber, said part being at least the last one as seen in press direction, and an opening that can be freed by the mobile partition has at least the dimension A×B in the opening position thereof, such that a partial compressed bale formed in the press chamber can be transported through said opening and into the storage space.

An essential feature of the baling press according to the invention is that the actual compression of the pressed product pieces is accomplished in a press chamber which has a cross-sectional area that is considerably smaller than is the case with the baling presses known to date, e.g. a depth having only the dimension C/n. The pressed product pieces to be compressed are compressed in the press chamber of the device according to the invention under high pressure to initially form individual partial compressed bales which are separately transported into a storage space adjacent thereto, where they are then joined to further partial compressed bales already compressed or still to be compressed to form a compressed bale made of partial compressed bales layered one behind the other. For example, the press chamber has a depth which is only 1/n of the depth C of the compressed bale, so that n partial compressed bales are joined to form one compressed bale. The number n is greater or equal to 2; preferably, n is between 2 and 10; most preferably, n is between 3 and 5. Since only these one-dimension-less-sized partial compressed bales of the compressed bale to be formed are produced in the actual press chamber and the press shield, therefore, has only a surface size which is correspondingly smaller, the given power of the mechanical drive of the press shield allows generating a comparably higher surface pressure. This results in an improved compaction of the partial compressed bales and, therefore, the compressed bale as a whole. Hereby, the actual press chamber of the device designed according to the invention can be dimensioned relatively small. This results in a relative reduction of the required driving forces as well as, through the reduction of the surface of the press shield by one dimension, in a shortening of the lever arms and, therefore, in a relief of the mechanical drive and the guides and, last but not least, in a weight reduction and, therefore, in a cost reduction of the complete device.

In order to hold together the produced partial compressed bales before they are joined to form the compressed bale, it is provided that the storage space is provided with limiting devices exerting a preloading force on the partial compressed bales present in said storage space and preventing the partial compressed bales from reexpanding.

Since reexpansion essentially occurs only opposite to the press direction, it is preferably provided that the limiting devices are only provided in an arrangement acting in parallel to the press direction.

For the purpose of adjustment to different pressed product properties, at least one of the limiting devices is, appropriately, movable.

In order to facilitate operation of the device, a mechanical drive is, preferably, provided for moving the limiting device.

A further embodiment provides that the partition between the press chamber and the storage space can be moved over its entire length, preferably in parallel to the press direction.

In particular for reasons of an ergonomic arrangement of the components of the device, the partition between the press chamber and the storage space is, appropriately, a rear wall of the press chamber.

Furthermore, the invention proposes that the device comprises a transportation assembly with a mechanical drive wherein, with the partition being in the opening position, said transportation assembly can be used to transport a partial compressed bale from the press chamber through the opening and into the storage space.

In order to provide the compressed bale formed from the n partial compressed bales with a high density, it is preferably provided that the storage space comprises a motion stop for a first partial compressed bale present in the storage space and that a force pressing the n partial compressed bales against each other with their flat sides can be exerted on an nth partial compressed bale which is the last one present in the storage space, this being accomplished by means of said transportation assembly being moved out in transportation direction or by means of a wedge-shaped formation of the side of the partition facing the storage space with said partition being moved in closing direction.

Preferably, the compressed bale produced can be removed or pushed or ejected or dumped out from the storage space in a direction extending transversely in relation to the transportation direction of the transportation assembly, preferably in lateral direction. In this embodiment, an access to the device from the rear side thereof is not necessary, this allowing space-saving installation, e.g. in front of a wall.

Alternatively, it is provided that the motion stop can be moved and/or removed and that the compressed bale produced can be removed or pushed or ejected or dumped out from the storage space in a direction extending in the transportation direction of the transportation assembly.

In order to avoid manual joining of the partial compressed bales, it is, furthermore, provided that a joining assembly is allocated to or arranged downstream from the storage space, wherein said joining assembly can be used to fully or semi-automatically attach to each of the n partial compressed bales a tie or strap, preferably of wire, steel band or plastic band, and/or a covering, preferably of plastic film, said tie or strap and/or covering joining said n partial compressed bales to each other and holding them together.

In order to achieve a particularly high-degree compaction of the pressed product, the press shield and its mechanical drive are, preferably, designed for a full stroke, i.e. for a stroke reaching down to directly before a floor of the press chamber.

In order to allow simple and safe operation of the device, it is proposed that a filler door forming a part of one of the walls of the press chamber is arranged in an upper part of the press housing, wherein said filler door can be swiveled about a horizontal axis and frees a filler inlet of the press chamber if it is in an opening position and closes the filler inlet if it is in a closing position.

A further embodiment is characterized in that the axis of the filler door extends at the bottom edge thereof, that the filler door is, in essence, positioned in a horizontal plane if it is in its opening position, that an upward facing flat side of the open filler door forms a receiving surface for pressed product pieces to be compressed, and that, with the press shield moved up, the pressed product pieces can be dumped into the press chamber by swiveling the filler door into its closing position. In this manner, operators are prevented from having to reach into the press chamber, thus excluding potential risks of injury associated therewith.

In order to facilitate operation, the filler door can, appropriately, be swiveled by means of a mechanical drive.

In order to allow operating personnel easy access to the filler door, the filler door is, preferably, arranged on a side of the press housing opposite to the storage space, preferably on a front wall of the press housing.

In order to prevent pressed product pieces placed onto the upward facing flat side of the open filler door from falling down to the side while said filler door is swiveled, it is advantageously proposed that guide walls that can be swiveled along with the filler door are provided on the sides thereof or that stationary guide walls on the press housing are provided to the sides of the filler door, wherein the guide walls form limits to the sides of the receiving surface.

Furthermore, the invention provides that an upper guide wall is arranged on the press housing above the filler door wherein, in its vertical distance from the filler door, said upper guide wall can be moved between an opening position allowing placing the pressed product pieces to be compressed onto the receiving surface of the open filler door and a closing position shielding the receiving surface of the open filler door that is swiveling in closing direction. In its closing position, the upper guide wall, thus, ensures that the pressed product placed onto the receiving surface is completely transferred into the press chamber without impeding the placement of the pressed product pieces onto the receiving surface in its opening position.

In order to achieve the forces required, the/each mechanical drive is, preferably, formed by at least one hydraulic cylinder.

In order to achieve a compact arrangement of the parts of the device, the at least one hydraulic cylinder forming the mechanical drive for moving the press shield is, preferably, arranged on the press housing above or to the side of the press chamber.

Furthermore, the mechanical drive for moving the press shield is, preferably, formed by a hydraulic master-slave cylinder pair. In this manner, an excellent synchronous operation of the two cylinders and the associated pistons and piston rods is achieved, this preventing the press shield from tilting or canting in a harmful or at least disturbing manner.

A preferred embodiment of the device provides that the press direction extends vertically from top to bottom or horizontally and that, in each case, the transportation direction extends perpendicularly thereto in a horizontal direction and in the direction of the edges of the partial compressed bales having the edge length C/n. To be transported in transportation direction, the partial compressed bales can, thus, be loaded with the transportation force on their largest surface, this affecting the coherence of the partial compressed bales least of all.

A further embodiment of the device is characterized in that the press chamber has a vertically extending longitudinal direction and the press direction extends vertically from top to bottom in parallel to the longitudinal direction and that each partial compressed bale can be transferred from a lower region of the press chamber into the storage space which is arranged at the appropriate height. This embodiment of the device comprises an issue for the partial compressed bales, said issue being approximately positioned at the height of a floor level on which the device is arranged. The issued partial compressed bales can, then, be joined to each other on the same level to form the larger compressed bale, and the compressed bale produced can be made available on the floor level for being transported away.

An alternative embodiment of the device is characterized in that the press chamber has a vertically extending longitudinal direction and the press direction extends vertically from bottom to top in parallel to the longitudinal direction and that each partial compressed bale can be transferred from an upper region of the press chamber into the storage space which is arranged at the appropriate height. In this embodiment of the device, the press direction extends from bottom to top, whereby the particularly produced partial compressed bale is generated in an upper region of the press chamber and is also issued from the upper region of the press chamber. In this case, the storage space is also arranged at an elevated position as compared with the floor level, with the result that the joining of the partial compressed bales to form the compressed bale produced can also be accomplished at an elevated level. In this manner, the device can, for example, be advantageously arranged adjacent to a loading platform wherein the height of the storage space is adjusted to the height of the loading platform. Compressed bales produced can then, for example, be transferred from the loading platform into a transport vehicle at the same height. Alternatively, this embodiment of the device provides the advantageous possibility of arranging the device in a recess or pit wherein, in this case, the arrangement is appropriately made such that the storage space into which the partial compressed bales are issued has the floor level surrounding the recess or pit. Since, in this device, the press direction extends from bottom to top, the press chamber is, of necessity, filled with the pressed product pieces to be compressed in a lower region of the press chamber. If the device is arranged in a recess or pit, this facilitates charging of the press chamber with the pressed product pieces because an operator then does not have to lift the pressed product pieces but can supply them down to the press chamber in one direction.

A further alternative embodiment of the device is characterized in that the press chamber has a longitudinal direction that extends obliquely in relation to the vertical direction and the press direction obliquely extends from bottom to top in parallel to the longitudinal direction and that each partial compressed bale can be obliquely transferred from an upper region of the press chamber down into the storage space which is arranged at the appropriate height. This embodiment of the device particularly allows achieving that gravity supports the transfer of the partial compressed bales from the press chamber into the storage space as well as the discharge of complete compressed bales produced in the storage space. In this manner, required mechanical drives can be designed with a lower power. In addition, an oblique position of the press chamber reduces the room height required for installation of the device with a given length of the press chamber.

An embodiment proposes that there is an angle $\alpha$ of no more than 45°, preferably between 15° and 30°, between the vertical direction and the press direction of the press chamber, said press direction extending obliquely in relation to said vertical direction.

Preferably, the storage space has a longitudinal and transportation direction that extends perpendicularly in relation to the press direction of the press chamber because this allows a favorable transfer of the partial compressed bales into the storage space and a compact arrangement of the parts of the device is achieved. Transportation problems occurring during the transfer of a partial compressed bale from the press chamber into the storage space, for example canting, are therefore prevented.

The press direction from bottom to top provides the possibility of arranging a gravity transportation section for the compressed bales downstream from the storage space. A gravity transportation section is to advantage in that it does not require its own drive elements, such as electric motors, because gravity acting on the compressed bales is, in itself, sufficient for the transportation. The gravity transportation section can be to particular advantage if it is used with the embodiment of the device where the storage space is arranged in the upper region of the device because, in this case, a sufficient slope of the transportation section can be realized for the discharge of the compressed bales. In this manner, it is, for example, possible to deposit each compressed bale on a flat transport vehicle or a pallet with the least of technical complexity, in order to transport away the compressed bale thereafter.

Therein, the gravity transportation section is, preferably, formed by a slideway or roller track extending in an inclined direction.

In order that as much pressed product as possible can be inserted in the press chamber for a press stroke of the press shield, a further development of the device provides that the latter has a charging assembly which comprises at least one rotationally drivable rotor roller equipped with transportation spikes, wherein said rotor roller is arranged upstream from and/or in a filler inlet of the device and the rotation of which can be used to transport pressed product pieces from outside of the press housing through the filler inlet and into the press chamber.

Furthermore, it is preferably provided for the device that the latter has a charging assembly which comprises at least one rotationally drivable rotor roller equipped with transportation spikes, wherein said rotor roller is arranged upstream from and/or in a filler inlet of the device and the rotation of which can be used to transport pressed product pieces from outside of the press housing through the filler inlet and into the press chamber. Such a charging assembly allows transporting a relatively large quantity of pressed product pieces into the press chamber in a forced manner, wherein there is already a precompaction. Hereby, the pressing process is accelerated because fewer press strokes are required for generating a partial compressed bale. Moreover, operation of the device is simplified for operating personnel because said operating personnel does not have to pack pressed product pieces into the press chamber with much effort.

Further simplification of the operation of the device and an increase in safety at work for operating personnel is achieved by the charging assembly, preferably, having a fill chamber arranged upstream from the rotor roller, wherein the pressed product pieces to be compressed can be placed or thrown into said fill chamber and the pressed product pieces can be transported from said fill chamber and into the press chamber by means of said rotor roller.

To achieve this, it is preferably provided in a further embodiment that the fill chamber is formed by a box which is open at its top and has an opening towards the rotor roller on its side facing the filler inlet of the device.

In order to ensure that the pressed product pieces inserted into the fill chamber safely arrive at the rotor roller and are reliably seized and transported into the press chamber by means of said rotor roller, the invention further proposes that a transportation assembly which can be used to supply pressed product pieces inserted in the fill chamber to a pressed product receiving region of the rotor roller is arranged in the fill chamber.

In a first embodiment, the transportation assembly can consist of a swivel shield or a sliding shield which can, appropriately, be moved by means of a mechanical drive.

In an alternative embodiment, it is provided that the transportation assembly consists of a conveyor belt.

A further development of the aforementioned embodiment provides that an end of the conveyor belt forming the transportation assembly can be adjusted in its height in relation to the charging assembly and be locked at a desired height, said end facing the charging assembly. This allows optimizing the transfer of pressed product pieces from the conveyor belt to the rotor roller of the charging assembly, in particular in relation to the properties of the pressed product pieces to be compressed, such that a swift transportation without any congestion can be achieved.

BRIEF DESCRIPTION OF THE DRAWINGS

Below, exemplary embodiments of the invention will be illustrated in more detail by means of a drawing. In the drawing.

DETAILED DESCRIPTION OF THE DRAWINGS

Figure 1:
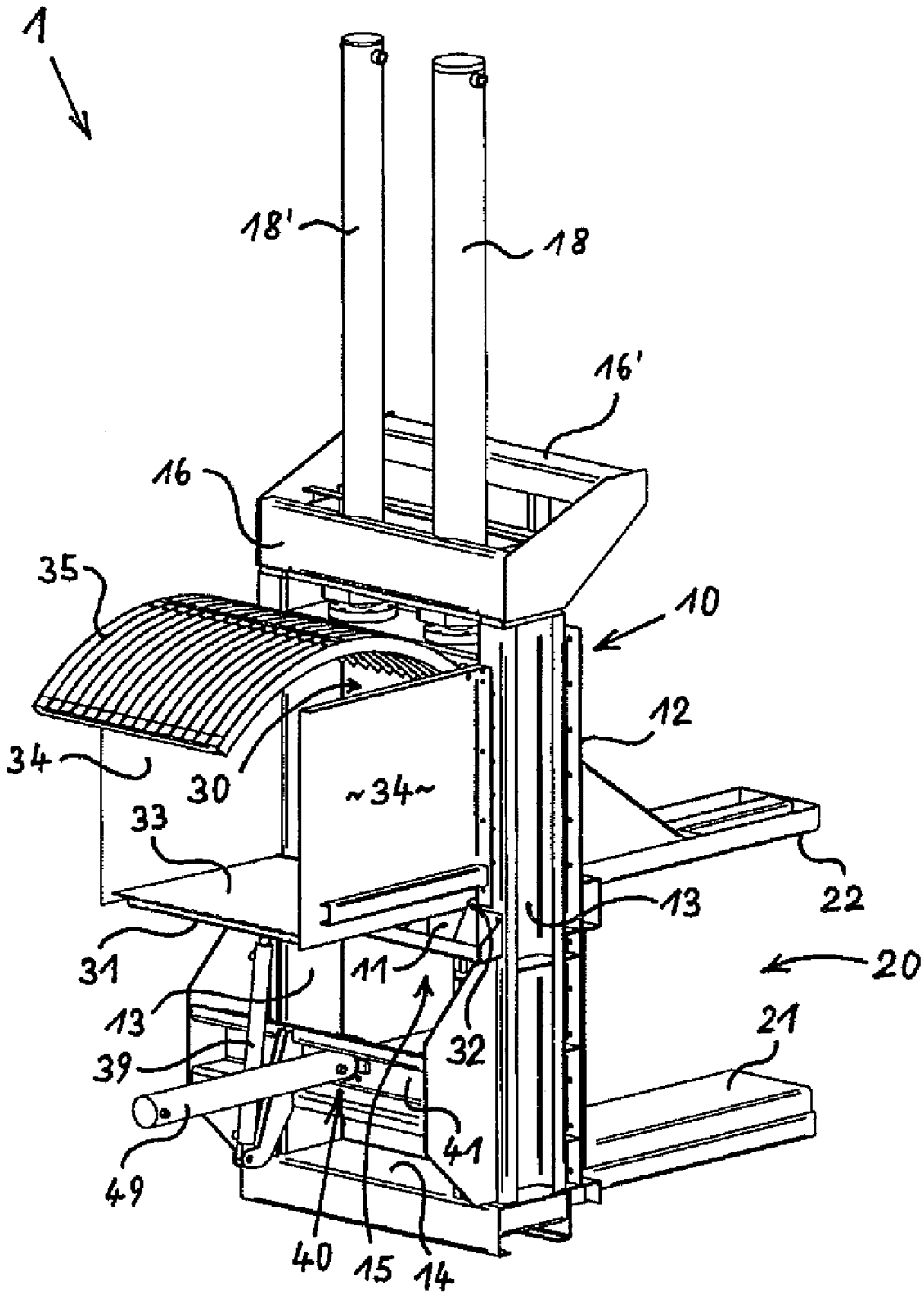
FIG. 1 is an angled front view of a device according to a first embodiment in a first operating phase.
Figure 2:
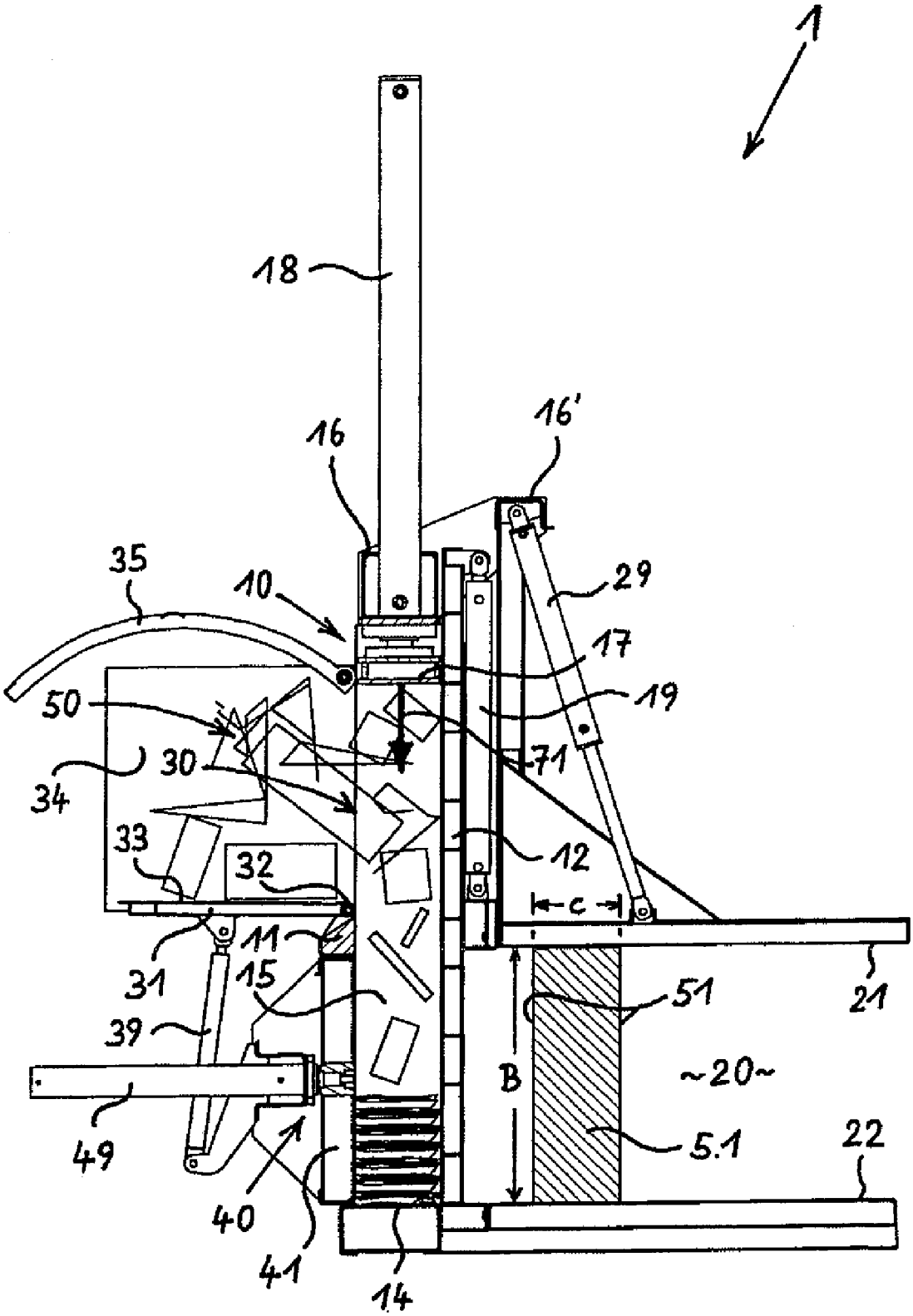
FIG. 2 is a vertical sectional view of the device in a second operating phase.
Figure 3:
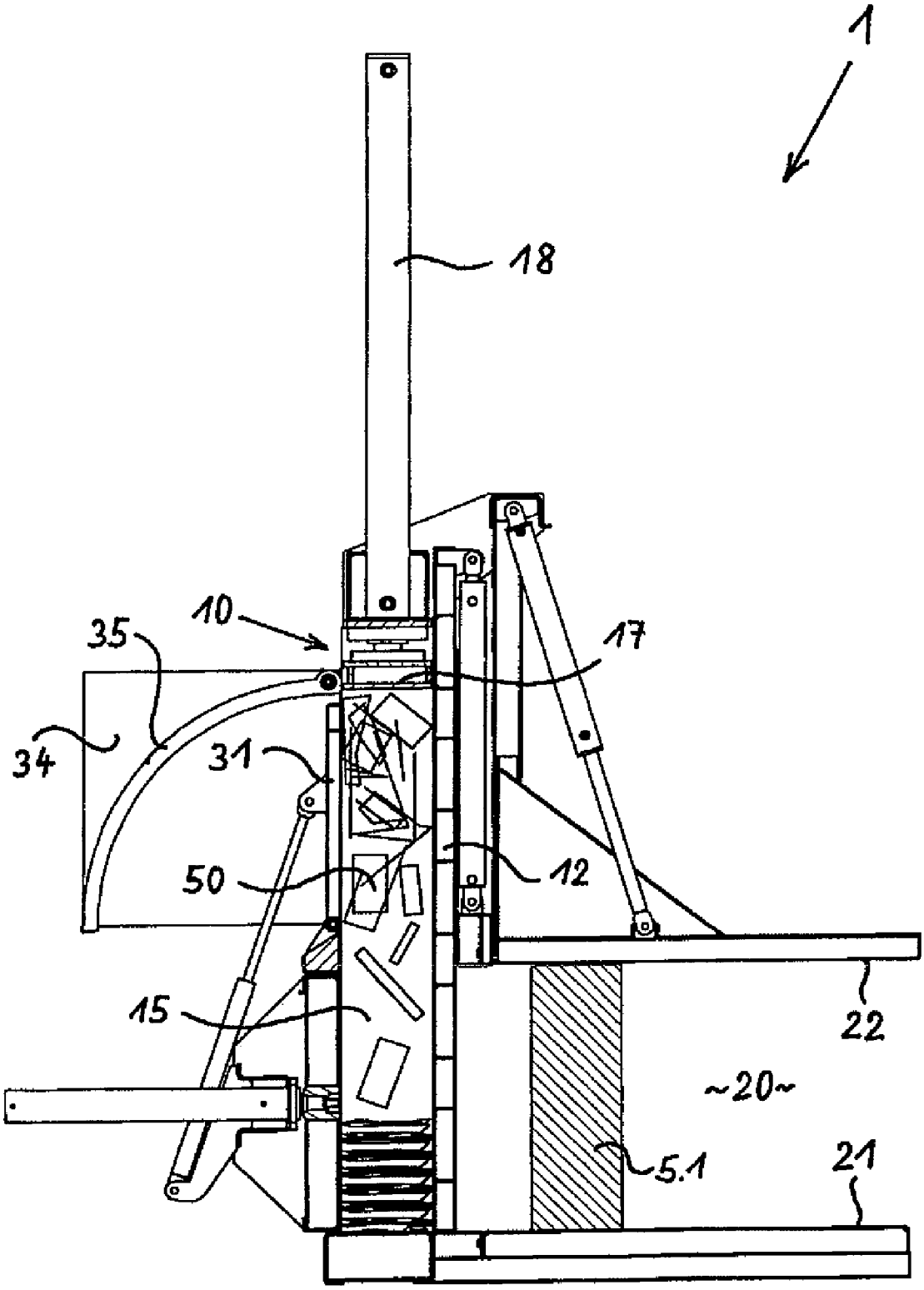
FIG. 3 is a vertical sectional view of the device in a third operating phase.
Figure 4:
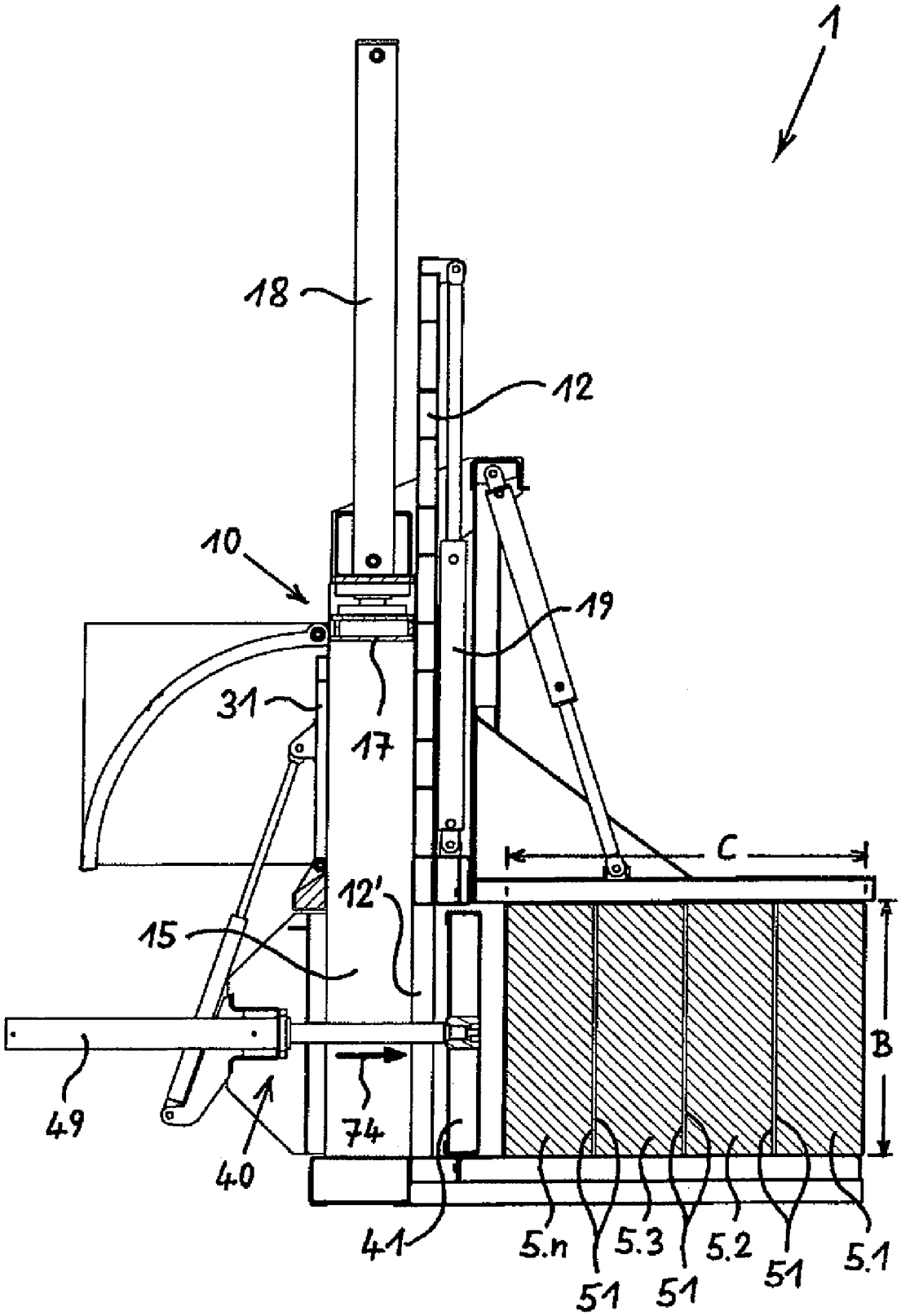
FIG. 4 is a vertical sectional view of the device in a fourth operating phase.

As shown in FIGS. 1 to 5, the device 1 according to the first exemplary embodiment shown consists of a vertically arranged press housing 10 with a front wall 11, a rear wall 12, two lateral walls 13, and a floor 14. The walls 11 to 13 and the floor 14 form limits to a press chamber 15 for receiving pressed product pieces 50 to be compressed. As can be recognized, the horizontally measured width A of the press housing 10 is a multiple of the horizontally measured depth c of the press housing 10 and, therefore, of the press chamber 15 positioned therein. As a result, the cross-section of the press chamber 15 is a narrow rectangle and is, therefore, considerably different from the rather approximately square cross-sections of conventional baling presses.

A filler inlet 30 with a swiveling filler door 31 is positioned at the top of the front wall 11. In the illustrated instance, the filler door 31 can be swiveled about a horizontal axis 32 extending along the bottom edge of the filler door 31 by means of a mechanical drive 39 having the form of a hydraulic cylinder. This filler door 31 is put into a horizontal position for filling the press chamber 15. Then, the pressed product pieces 50 to be compressed are placed onto the upper side of the filler door 31, said upper side forming a receiving surface 33. In order to prevent pressed product pieces 50 from falling down from the receiving surface 33, the filler door 31 is limited by two guide walls 34 to the right and left, said lateral guide walls 34 being stationary and being connected to the press housing 10.

In order to prevent pressed product pieces 50 from being squeezed away to the top while the filler door 31 is actuated, an upper limiting device of the filling region is provided above the receiving surface 33 of the filler door 31 by means of an upper guide wall 35 that can be opened, said upper guide wall 35 having the form of a grating in the illustrated instance. The upper guide wall 35 that can be opened is put into an upper position during filling of the receiving surface 33. Before the filler door 31 is moved hydraulically, the upper guide wall 35 that is adjusted in its form to the radius of movement of the front edge of the filler door 31 is put in its lower position and guides the pressed product pieces 50 present on the receiving surface 33 upwards into the press chamber 15 during the movement of the filler door 31.

In the interior region of the press housing 10, a press shield 17 is guided in vertical direction such that it can be moved down in press direction 71 and vice versa. While pressed product pieces 50 are inserted through the filler inlet 30, the press shield 17 is in its upper end position.

To move the press shield 17, a mechanical drive 18, 18' is provided which, in the illustrated instance, has the form of two hydraulic cylinders extending in parallel to each other and forming a master-slave system, said hydraulic cylinders being received at a transverse yoke 16 attached to the top of the press housing 10 above the press chamber 15 extending in vertical direction and said hydraulic cylinders projecting beyond the press housing 10 towards the top. If installation rooms for the device 1 are particularly low, these cylinders can, alternatively, also be attached to the sides of the press housing 10 and are, then, connected to the press shield 17, for example by means of angular levers.

In the master-slave cylinder pair of the mechanical drive 18, 18', the return oil stream from the master cylinder is used as the drive oil stream from the allocated slave cylinder and vice versa. Provided that the size of the ring surface of the master cylinder is equal to the size of the piston area of the slave cylinder, it is ensured that the two piston rods of the master-slave cylinder pair are uniformly moving in and out. The use of such a master-slave cylinder pair stabilizes the guide of the press shield 17. That is to say, the press shield 17 is driven by synchronously operating hydraulic cylinders on either side, thus being guided reliably. Should the feed be impeded by irregular filling or differently compressible pressed product pieces 50, the system is stopped as a whole.

Since the press shield 17 is adjusted to the narrow rectangular cross-section A×c of the press chamber 15 and, therefore, has only a correspondingly low depth, it is also possible to easily compensate the load that can be caused by irregular filling in this dimension. In conventional baling presses, a canting of the press shield 17 in the horizontal depth dimension can occur very often. In the device 1 shown, however, this dimension is only a fraction of the press chamber depth resulting in known vertical baling presses. As a result, a canting of the press shield 17 across the depth of the press chamber 15 is rather improbable.

In a pressing process, the best compaction results and bale densities can be achieved if the press shield 17 can, if possible, travel across a full stroke down towards the floor 14 of the press chamber 15. As a result, the partial compressed bales **5.1-5.*n* produced in the present device 1 are compressed to the same degree, as seen over their total height B. Owing to the special cross-sectional form of the press chamber 15, partial compressed bales 5.1-5.*n* with the dimensions A×B×c are produced in said press chamber 15, wherein the dimension c is an integer fraction of the corresponding dimension C of the complete compressed bale 5** to be produced; that means that c=C/n. Therein, n is greater than or equal to 2; preferably, n is between 2 and 10; most preferably, n is between 3 and 5.

The rear wall 12 of the press housing 10 can be moved in vertical direction by means of a further mechanical drive 19, which is a hydraulic cylinder in the illustrated instance. A storage space 20 is positioned behind the rear wall 12, said storage space 20 receiving the n partial compressed bales **5.1-5.*n* which are produced step by step in the press chamber 15 in individual pressing processes and are then transported out of the press chamber 15 and into the storage space 20. Before a partial compressed bale 5.1-5.*n* produced in the press chamber 15 is pressed into the storage space 20 by means of a horizontally acting transportation assembly 40 comprising a transportation shield 41, the rear wall 12 is moved up, thereby freeing an opening 12' from the press chamber 15 to the storage space 20, said opening 12' being appropriate in size and having at least the dimension A×B. The transportation shield 41 of the transportation assembly 40 can be moved by means of a further mechanical drive 49** which is also formed by a hydraulic cylinder.

The storage space 20 in which the partial compressed bales **5.1-5.*n* later forming a complete compressed bale 5 are collected and temporarily kept, is formed by two limiting devices 21 and 22 that are acting in press direction, are horizontally extending in parallel to each other and are vertically spaced apart from each other. The limiting devices 21, 22 have the form of relatively narrow slideways the spacing of which is adjusted to the height B of the partial compressed bales 5.1-5.*n* such that a reexpansion of the partial compressed bales 5.1-5.*n*** is prevented.

The pressed product present in the partial compressed bales **5.1-5.*n* at the vertical sides thereof does not tend to flow apart, and restoring forces in the partial compressed bales 5.1-5.*n* can, practically, only be registered in a direction opposite to the press direction 71. This provides excellent access to the partial compressed bales 5.1-5.*n* for joining them in the storage space to form the compressed bale 5, so that a bale band 60** or bale wire used as a tie can, for example, be easily put in the proper position. Therein, the tie can be applied manually or by means of a fully or semi-automatic tie system which is not shown in the drawing.

The tie 60 to form the compressed bale 5 produced is applied after all of the n partial compressed bales **5.1-5.*n* to be combined to form the compressed bale 5 have been produced and transported step by step into the storage space 20 by means of the horizontally acting transportation assembly 40. The partial compressed bales 5.1-5.*n* that are bearing against each other with their flat sides 51 and are held between the limiting devices 21, 22 in a clamping manner can be compressed and tied in horizontal direction for final compaction by means of the transportation shield 41**.

Figure 5:
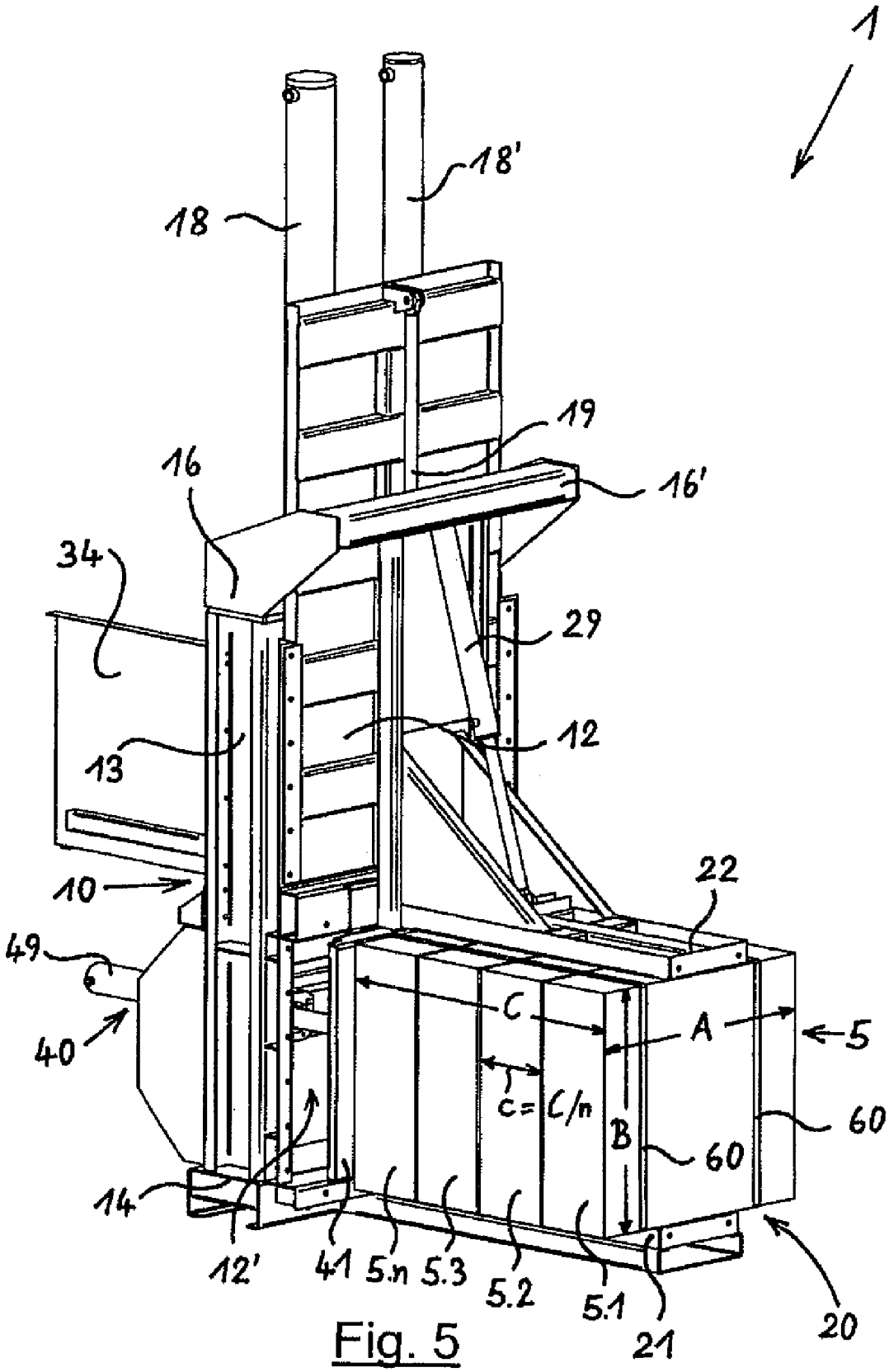
FIG. 5 is an angled overall rear view of the device in a fifth operating phase.

FIG. 5, for example, shows four partial compressed bales **5.1-5.*n* (n=4 in the illustrated instance), each having the dimensions A×B×C/4, are combined to form the compressed bale 5** having the dimensions A×B×C.

If necessary, the limiting devices 21, 22 can have a motion stop for the first partial compressed bale 5.1 at their free end, if the clamping of the partial compressed bales **5.1-5.*n* between the limiting devices 21, 22** does not suffice for the final horizontal compression.

The rear wall 12 can, alternatively, be designed such that its side facing the storage space 20 is not extending in parallel to its side facing the press chamber 15 but at an acute angle in relation to the press chamber 15. As a result, the rear wall 12, while moving down, compresses the partial compressed bales **5.1-5.*n* such that intermediate spaces between the individual partial compressed bales 5.1-5.*n* are minimized because the limiting devices 21, 22 of the storage space 20 or stops provided thereon prevent the first partial compressed bale 5.1** from sliding further.

As an alternative, it is also conceivable that the side of the rear wall 12 facing the storage space 20 can, in itself, be moved further towards the partial compressed bales **5.1-5.*n*** by a sufficient travel amount, either hydraulically or by means of a lever or spring mechanism, in order to compress said partial compressed bales 5.1-**5.*n*** horizontally in a final step.

In their compressed state, the partial compressed bales 5.1-**5.*n* are joined, e.g. strapped with an appropriate strapping material 60, such as wire or PP band, to form the compressed bale 5**. The joining means are then tensioned and tied or bound together.

In the next step, the compressed bales 5 produced can be removed from the device 1. To achieve this, the upper limiting device 22 of the storage space 20 is turned or moved up, for which purpose a further mechanical drive 29 is provided in the illustrated instance. This mechanical drive 29 is again formed by a hydraulic cylinder which is supported against a transverse support 16' of the press housing 10 on the rear side thereof.

For example, the compressed bale 5 can be dumped or pushed onto a pallet positioned in parallel to the storage space 20 in the longitudinal direction thereof, since the dimensions A and B are essentially equal here. The dimension C is approximately 50% larger than the dimensions A and B. Appropriately, the compressed bale 5 is issued by a hydraulically or manually actuated lever mechanism which is not shown in the drawing. Therein, the surface of the compressed bale 5 with the edges B and C or A and C, which is placed on the pallet by dumping or pushing, essentially corresponds to the dimensions of the pallet, e.g. 1.200 mm×800 mm in case of a europallet, to utilize the transport space in a favorable manner.

For a new cycle, the transportation shield 41 of the horizontally acting transportation assembly 40 is moved back and the hydraulically movable rear wall 12 is again moved down.

Figure 6:
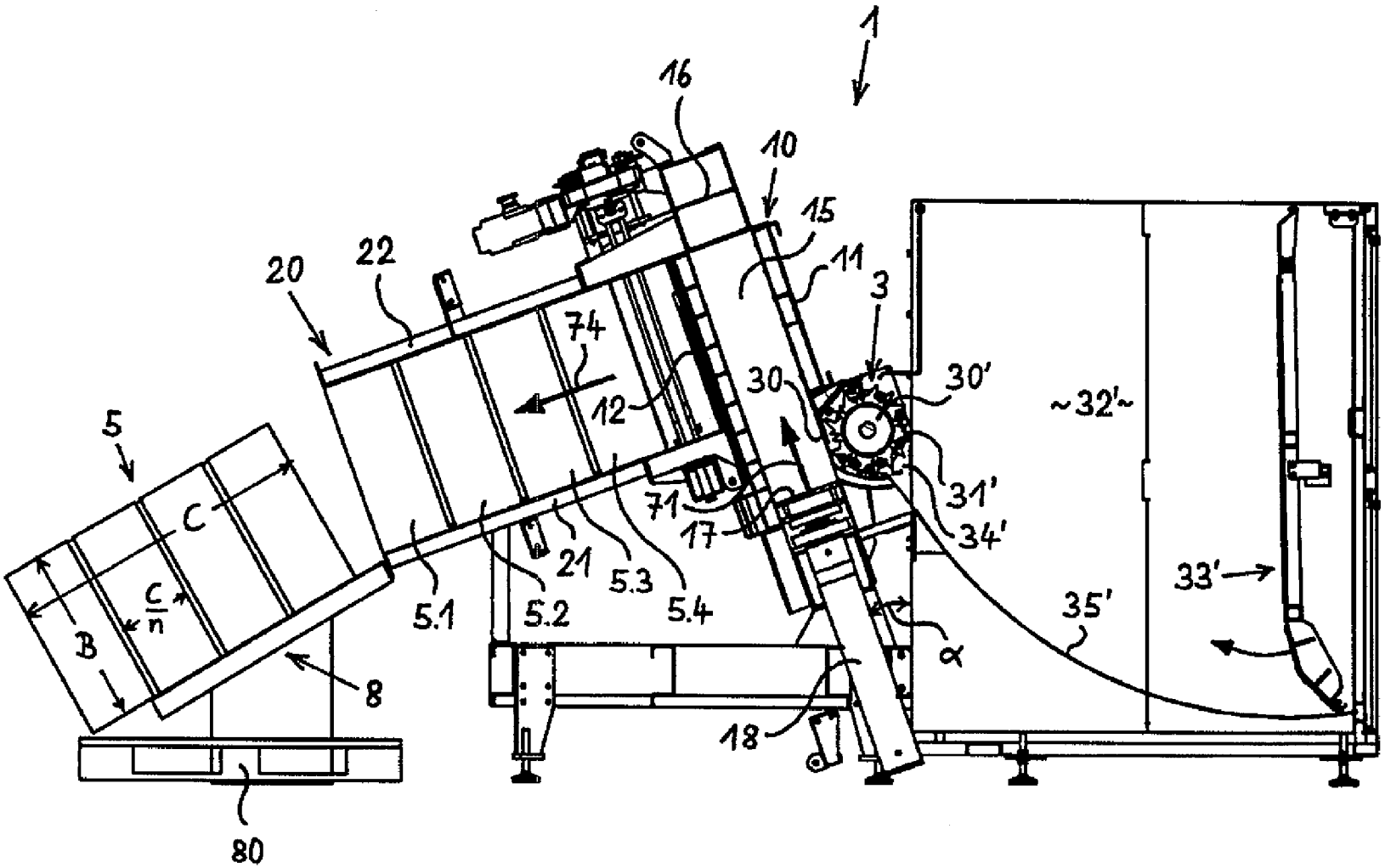
FIG. 6 is a vertical longitudinal sectional view of a second embodiment of the device.

FIG. 6 of the drawing shows a second device 1 for producing compressed bales 5 from compressible pressed product pieces, in particular residues, such as used paper, used paperboard containers, plastic films or empty plastic bottles. The core of the device 1 is formed by a press consisting of a press housing 10 comprising a press shield 17 that can be moved in said press housing 10 by means of a mechanical drive 18. FIG. 6 shows the press shield 17 in its retracted position, that is in its state prior to a press stroke.

In the illustrated instance, the press shield 17 and its mechanical drive 18 are arranged at a lower end of the press chamber 15, this resulting in a press direction 71 of the press shield 17 according to the arrow from bottom to top.

Furthermore, the press housing 10 is arranged obliquely in relation to the vertical direction with its press chamber 15, wherein an angle α, which is approximately 20° in the illustrated instance, exists between the press direction 71 and the vertical direction.

Towards the front, i.e. to the right in FIG. 6, the press chamber 15 is limited by a front wall 11. This front wall 11 can be moved to the rear perpendicularly in relation to its plane area, i.e. to the left in FIG. 6, by means of a mechanical drive, such as hydraulic cylinders. To the rear, i.e. to the left in FIG. 6, the press chamber 15 is limited by a rear wall and partition 12. This rear wall and partition 12 can be moved, for example pushed up, such that it, optionally, closes the press chamber 15 or frees an opening for the issue of a partial compressed bale 5.1 to 5.4. The press chamber 15 is limited towards the top by a transverse yoke 16. On its sides, the press chamber 15 is closed by two lateral walls.

A fill chamber 32' having the form of a box that is open at its top is arranged to the right of the press housing 10, wherein pressed product pieces to be compressed can be thrown into said fill chamber 32'. The fill chamber 32' has a bent floor 35' which can be swept by a transportation shield of a transportation assembly 33', wherein said transportation shield can be swiveled in parallel to said bent floor 35'.

A charging assembly 3 is arranged between the fill chamber 32' and a filler inlet 30 of the press chamber 15. In the illustrated instance, the charging assembly 3 consists of a rotationally drivable rotor roller 30' which is equipped with transportation spikes 31' along its circumference. By means of the transportation assembly 33', pressed product pieces thrown into the fill chamber 32' can be supplied to a pressed product receiving region 34' of the rotor roller 30' where the pressed product pieces are then seized by the rotating rotor roller 30' and its transportation spikes 31' and transported into the press chamber 15 in a forced manner. As soon as the press chamber 15 is sufficiently filled with pressed product pieces, the distance of a guide surface 10 below the transportation spikes 31' is, initially, brought to the minimum possible distance from the transportation spikes 31'. As a result, the remaining product pieces which are still in the rotor roller 30' are transported into the press chamber 15 without the rotor roller 30' seizing further pressed product pieces from the fill chamber 32'. After further pressed product pieces are no longer pushed out of the press chamber 15 and into the fill chamber 32', the charging assembly 3 is then stopped and the press shield 17 is moved in press direction 71 by means of its mechanical drive 18. If necessary, this process is repeated several times until a partial compressed bale 5.1 to 5.4 is produced in the desired size and density in the upper region of the press chamber 15.

After the rear wall and partition 12 has been opened, each partial compressed bale 5.1 to 5.4 is transported out of the press chamber 15 and into a storage space 20 in the transportation direction indicated by the arrow 74. This transportation is accomplished by moving the front wall 11 in the direction of the arrow 74 by means of its mechanical drive, e.g. a hydraulic piston-cylinder unit. The storage space 20 has a lower limiting device 21 and an upper limiting device 22 together ensuring that the partial compressed bales 5.1 to 5.4 are held bearing against each other with their flat sides and are prevented from reexpanding.

The partial compressed bales 5.1 to 5.4 (four in the exemplary embodiment shown) are joined to form a compressed bale 5 by strapping with bands or like binding means, said compressed bale 5 being transferred onto a gravity transportation section 8 arranged adjacent to the storage space 20. In the illustrated instance, the gravity transportation section 8 is an inclined slideway via which the compressed bale 5 produced can be deposited onto a pallet 80. The compressed bale 5 produced has a height B and a length C which is composed of partial lengths C/n (n=4 in the illustrated instance). The width of the compressed bale 5 produced, measured perpendicularly in relation to the drawing plane, amounts to A and is not visible here.

Figure 7:
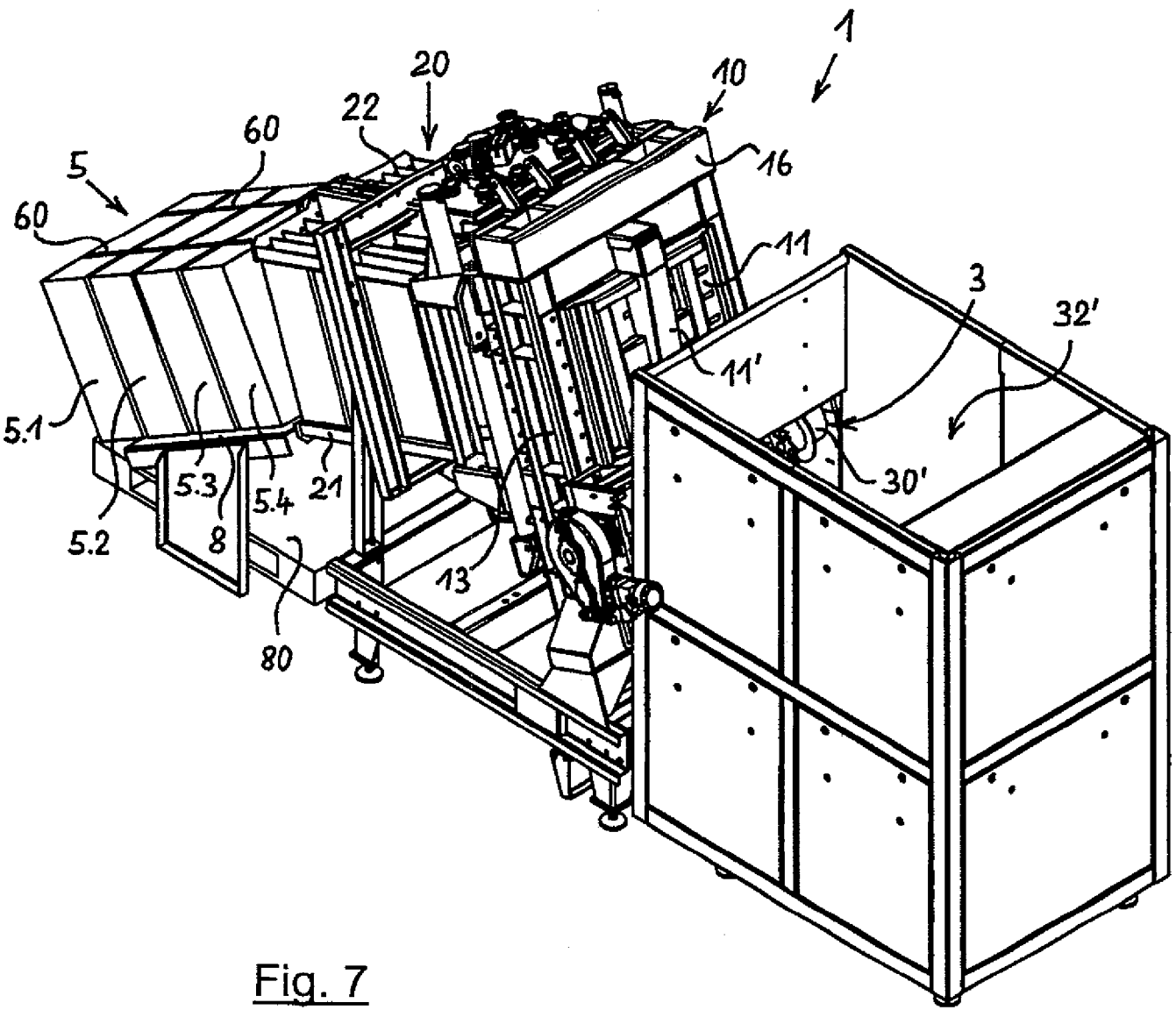
FIG. 7 is an angled front view of the device shown in FIG. 6 in perspective.

FIG. 7 is an angled front view of the device shown in FIG. 6 in perspective. The fill chamber 32' can be seen at the right front, with pressed product pieces being supplied from said fill chamber 32' to the charging assembly 3 by means of the rotor roller 30'. The press housing 10 of the device 1 is positioned after the fill chamber 32', the front wall 11 and the left lateral wall 13 of said press housing 10 being visible. The transverse yoke 16 is positioned on the press housing 10 on the upper side thereof. A slide profile 11' having the form of a rectangular tube can be seen in the middle of the front wall 11, with the mechanical drive for moving the front wall 11 being positioned in said slide profile 11'.

The storage space 20 with its lower limiting device 21 and its upper limiting device 22 is positioned after the press housing 10. The rear and last part of the device 1 is, finally, formed by the gravity transportation section 8 via which the compressed bale 5 produced, which consists of the partial compressed bales 5.1 to 5.4 having been produced beforehand, is deposited onto the pallet 80. The partial compressed bales 5.1 to 5.4 are held together by means of the joining means 60, for example straps made of plastic.

Figure 8:
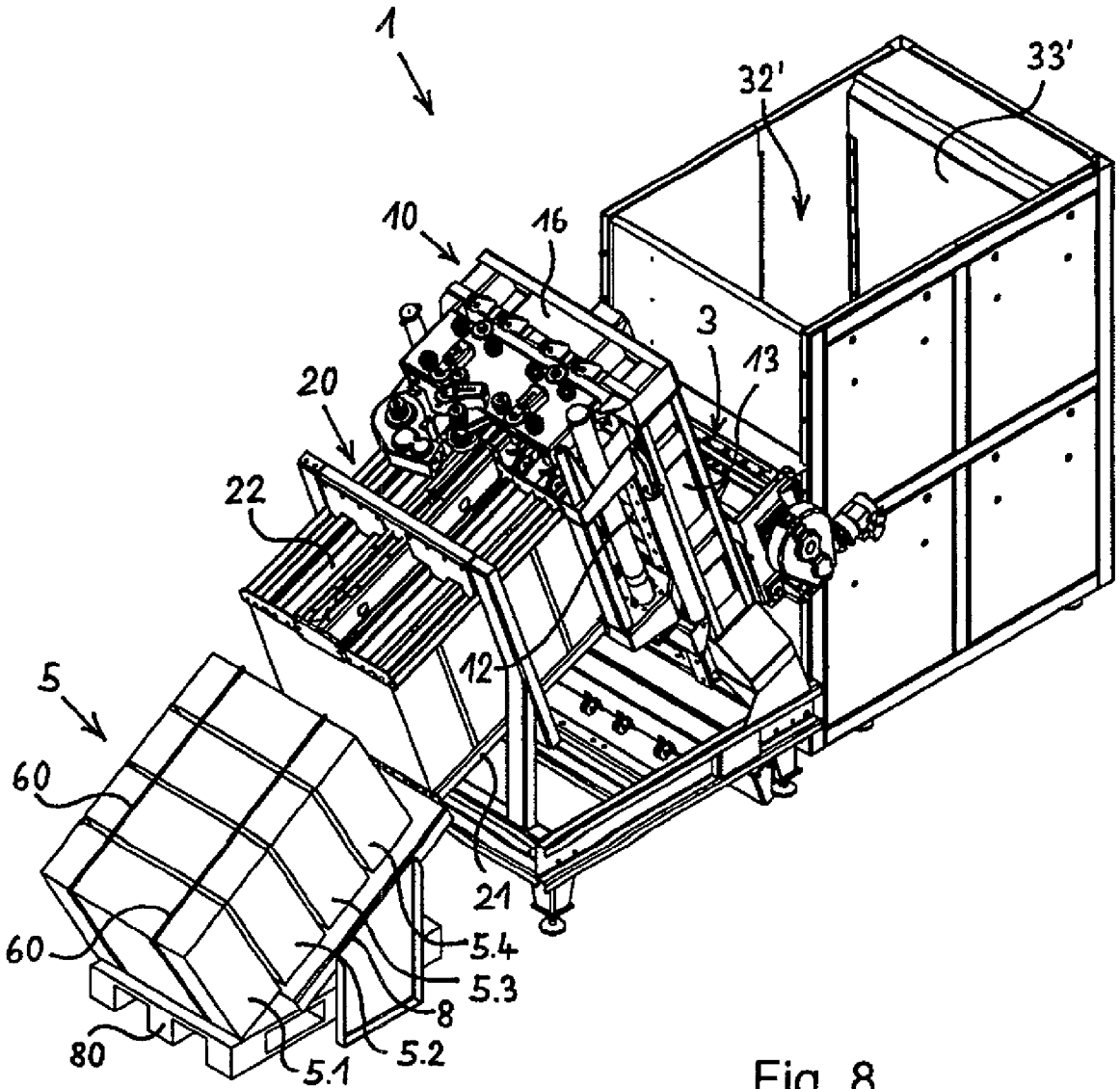
FIG. 8 is an angled rear view of the device shown in FIG. 6 in perspective.

FIG. 8 is an angled rear view of the device 1 shown in FIGS. 6 and 7 in perspective. The fill chamber 32' with the transportation assembly 33' arranged therein is shown to the right in FIG. 8. To the left, this is followed by the charging assembly 3 which is, in turn, followed by the press housing 10. Of the press housing 10, the rear wall and partition 12, one side wall 13 and the transverse yoke 16 arranged at the top can be seen in the illustrated instance.

Further to the left, FIG. 8 then shows the storage space 20 which is formed by the lower limiting device 21 and the upper limiting device 22.

The gravity transportation section 8 which serves to deposit the compressed bale 5 produced onto the pallet 80 forms the last part of the device 1, which can be seen to the front left in FIG. 8.

Figure 9:
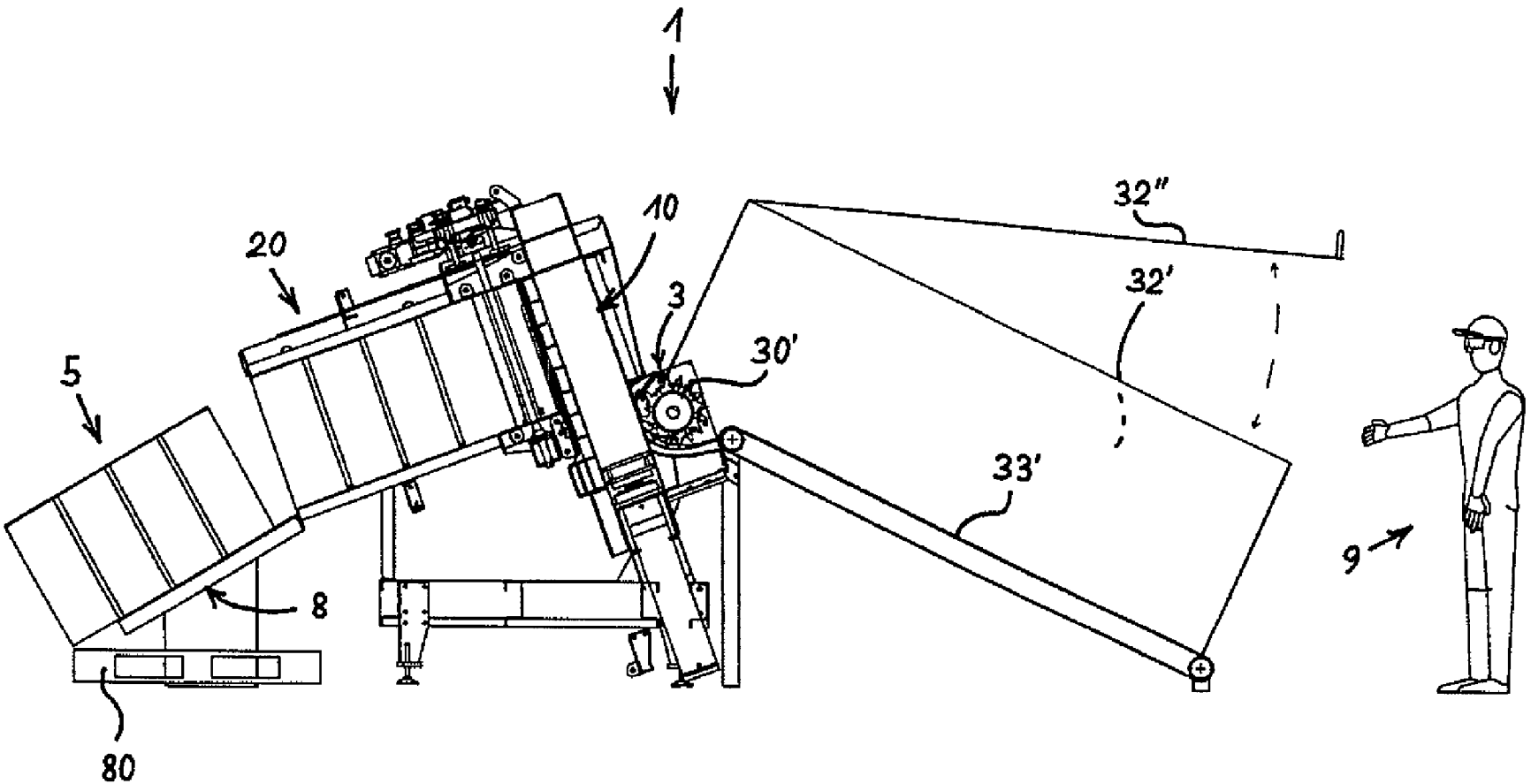
FIG. 9 is a lateral view of the device in a third embodiment.

FIG. 9 of the drawing shows a third embodiment of the device 1 for producing compressed bales 5 of compressible pressed product pieces. Apart from the fill chamber 32', which is arranged upstream from the charging assembly, and its transportation assembly 33' provided therein, the device 1 shown in FIG. 9 corresponds to the second exemplary embodiment described in FIGS. 6 to 8. As regards the design of the press housing 10, the charging assembly 3, the storage space 20 and the gravity transportation section 8, reference is, therefore, made to the preceding description of FIGS. 6 to 8.

Contrary to the exemplary embodiment described above, a conveyor belt is provided as transportation assembly 33' in the fill chamber 32' arranged upstream from the charging assembly 3 in the example of the device 1 shown in FIG. 9. The conveyor belt extends towards the charging assembly 3 in ascending direction and ends immediately in front of the rotor roller 30' thereof. The fill chamber 32' is closed on its sides and, in the illustrated instance, has a swiveling cover 32" on its top, said swiveling cover 32" being shown in its open position in FIG. 9. In this position of the cover 32", an operator 9 can throw pressed product pieces to be compressed into the fill chamber 32'.

By switching on a drive (not shown) of the conveyor belt forming the transportation assembly 33', said conveyor belt transports thrown-in pressed product pieces from the charging assembly 3 and into the operating range of the rotor roller 30' thereof. There, the pressed product pieces are seized by the rotor roller 30' and transported by the latter into the interior region of the press housing 10, as has already been described in detail above.

Figure 10:
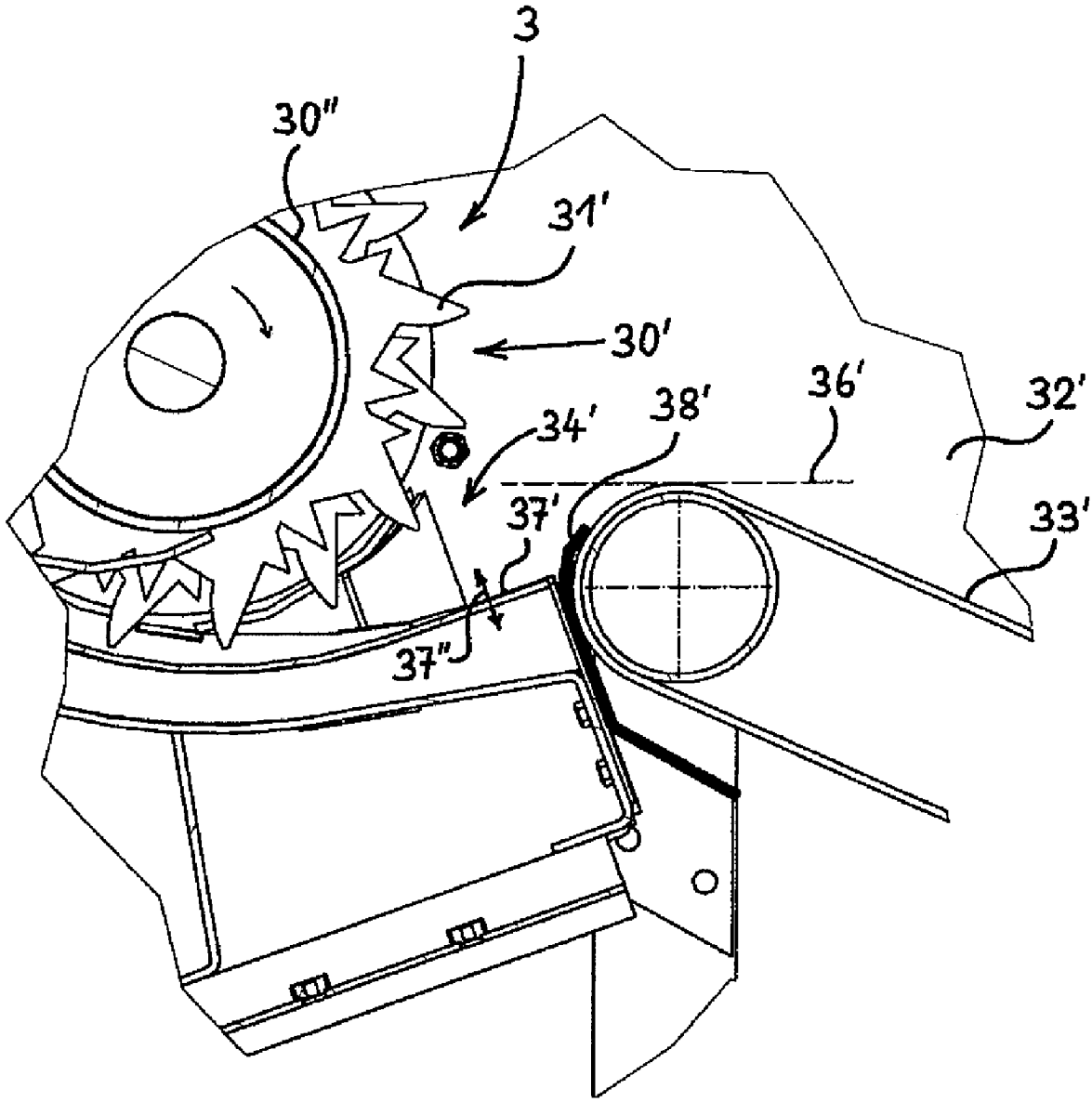
FIG. 10 is an enlarged detail view of the device shown in FIG. 9 in the region of its charging assembly.

FIG. 10 is an enlarged detail view of a region of transfer from the transportation assembly 33' to the charging assembly 3. The charging assembly 3 with its rotor roller 30' can be seen at the upper left of FIG. 10. The rotor roller 30' has a hollow cylindrical central tube 30", with the transportation spikes 31' being attached to the outer perimeter of said central tube 30".

A slotted guide surface 37' is positioned below the rotor roller 30', said slotted guide surface 37' being bent in its design in order to approximately follow the shape of the outer perimeter of the rotor roller 30' and said slotted guide surface 37' being adjustable in its distance from the rotor roller 30' in the sense of the double arrow 37". FIG. 10 shows the guide surface 37' in a position in which it is positioned as close to the rotor roller 30' as possible wherein the transportation spikes 31' then immerse into the slots of the guide surface 37'. This position is taken once the supply of pressed product pieces into the press chamber is terminated, said press chamber not being visible here.

The end region of the conveyor belt forming the transportation assembly 33' in the fill chamber 32' can be seen to the right of FIG. 10, said end region facing the charging assembly 3. The discharge height 36' of the transportation assembly 33' is represented by the horizontal dashed line. From this discharge height 36', the transportation assembly 33' transfers the pressed product pieces to be compressed to a pressed product receiving region 34' of the rotor roller 30'. There, the transportation spikes 31' seize the pressed product pieces with the rotor roller 30' rotating and transport them along the guide surface 37' and into the downstream press chamber. The discharge height 36' can be varied by adjusting the height of the discharge end of the conveyor belt, to optimize the transfer of the pressed product pieces to the charging assembly 3.

While the press chamber is being charged, the transportation assembly 33' continuously transports a stream from pressed product pieces to the rotor roller 30' which transports the pressed product pieces further into the press chamber, therein already accomplishing a precompaction. Once the press chamber is filled, the transportation assembly 33' is stopped so that new pressed product pieces are no longer transported to the rotor roller 30'. The rotor roller 30' continues transporting for a certain time until the last pressed product pieces have also been transported into the press chamber along the guide surface 37'.

With the continuous transportation that was the first one described above for filling the press chamber, the guide surface 37' has a wider distance from the rotor roller 30' so that as much pressed product as possible can be transported. At the end of the filling process of the press chamber, the distance of the guide surface 37' from the rotor roller 30' is reduced in order to transport all remaining pressed product pieces from the receiving region 34' of the rotor roller 30' into the press chamber. The adjustment of the distance of the guide surface 37' from the rotor roller 30' is accomplished in the direction of the double arrow 37". Once the residual transportation is completed and pressed product pieces are no longer present in a transition area between the charging assembly 3 and the press chamber, the rotor roller 30' is also stopped and a pressing process is carried out, such as it has already been described above.

A guard 38' which ensures that all pressed product pieces supplied on the conveyor belt are reliably transferred from the conveyor belt to the charging assembly 3 is arranged on the side of the conveyor belt facing the charging assembly 3, said guard 38' being adjusted to the shape of the conveyor belt which is curved there. If the sliding surface 37' is moved, a plate limiting the gliding surface 37' towards the transportation assembly 33' and offset downwards from the sliding surface 37' at an approximately right angle slides along a surface of the guard 38' extending in parallel thereto, so that a tight connection from the transportation assembly 33' to the charging assembly 3 is always ensured.

As is illustratively shown in FIGS. 6 to 9, the press direction 71 extends at an angle $\alpha$ in relation to the vertical direction whereby the complete height of the device 1 is reduced. The longitudinal and transportation direction 74 of the storage space 20 extends perpendicularly in relation to the press direction 71, this facilitating the transfer or ejection of a partial compressed bale 5.1 to 5.4 from the press chamber 15 into the storage space 20 because, in the illustrated instance, canting is prevented owing to a missing change in direction.

Furthermore, it can be seen that the transportation direction 74 obliquely extends from top to bottom, this facilitating the transportation of the partial compressed bales 5.1 to 5.4 as a result of the support through gravity. Last but not least, the gravity transportation section 8 extends downwards at an even somewhat steeper angle so that, in the illustrated instance, a compressed bale 5 produced is transported and can be deposited on the pallet 80 solely by the force of gravity without any drive means, by pulling the pallet 80 from under the gravity transportation section 8 in a forward direction, i.e. to the left according to FIGS. 6 to 9.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A device for producing cuboid compressed bales having a width A, a height B and a depth C as edge lengths, from compressible pressed product pieces, wherein the device comprises a press housing having at least one press chamber and a press shield that can be moved in the press chamber in a press direction and back by means of a mechanical drive, wherein a storage space is arranged downstream from the press chamber, wherein the press chamber is separated from the storage space by a partition that can be moved between a closing position and an opening position, the partition forming at least one part of a wall of the press chamber, the part being the last one as seen in press direction, and the partition freeing an opening when it is in its opening position, wherein the press chamber has a cross-sectional surface of A×C/n as seen perpendicular in relation to the press direction, wherein n is greater than or equal to 2, an opening that is made by the movable partition in the opening position thereof has at least the dimensions A×B, the device comprises a partial compressed bale transporting assembly with a mechanical drive, wherein the partial compressed bale transporting assembly has a transportation direction extending in parallel to the dimension C/n of the press chamber and extending out of the press chamber through the opening and into the storage space, and a joining assembly is allocated to or arranged downstream from the storage space, wherein said joining assembly can be used to fully-automatically or semi-automatically attach to each of the n partial compressed bales having the width A, the height B and the depth C/n as edge lengths a tie or strap or covering which joins the n partial compressed bales to each other and holds them together to form the compressed bale having the width A, the height B and the depth C as edge lengths, said tie or strap or coverage extending in parallel to the height B and the depth C of the compressed bale.

2. The device according to claim 1, wherein the storage space is provided with limiting devices.

3. The device according to claim 2, wherein the limiting devices are only provided in an arrangement acting in parallel to the press direction.

4. The device according to claim 2, wherein at least one of the limiting devices is mobile.

5. The device according to claim 4, wherein a mechanical drive is provided for moving the limiting device.

6. The device according to claim 1, wherein the partition between the press chamber and the storage space can be moved over its entire length.

7. The device according to claim 1 wherein the partition can be moved in parallel to the press direction.

8. The device according to claim 1, wherein the partition between the press chamber and the storage space is a rear wall of the press chamber.

9. The device according to claim 1, wherein the storage space comprises a motion stop for a first partial compressed bale present in the storage space.

10. The device according to claim 9, wherein the motion stop can be moved or removed.

11. The device according to claim 1, wherein the press shield and its mechanical drive are designed for a full stroke extending down to directly before a floor of the press chamber.

12. The device according to claim 1, wherein a filler door forming a part of one of the walls of the press chamber is arranged in an upper part of the press housing, wherein said filler door can be swiveled about a horizontal axis and frees a filler inlet of the press chamber when it is in an opening position and closes the filler inlet when it is in a closing position.

13. The device according to claim 12, wherein the axis of the filler door extends at a bottom edge thereof, the filler door is positioned in a horizontal plane when it is in its opening position and an upward facing flat side of the open filler door forms a receiving surface for pressed product pieces to be compressed.

14. The device according to claim 12, wherein the filler door can be swiveled by means of a mechanical drive.

15. The device according to claim 12, wherein the filler door is arranged on a side of the press housing opposite from the storage space.

16. The device according to claim 12, wherein guide walls forming limits to the sides of the receiving surface are provided that are one of limits that are provided on the sides of the filler door and can be swiveled along with the filler door or stationary guide walls on the press housing provided to the sides of the filler door.

17. The device according to claim 16, wherein an upper guide wall is arranged on the press housing above the filler door wherein, in its vertical distance from the filler door, said upper guide wall can be moved between an opening position allowing placing pressed product pieces to be compressed onto the receiving surface of the open filler door and a closing position shielding the receiving surface of the open filler door that is swiveling in closing direction.

18. The device according to claim 1, wherein each mechanical drive is formed by at least one hydraulic cylinder.

19. The device according to claim 18, wherein the at least one hydraulic cylinder forming the mechanical drive for moving the press shield is arranged on the press housing either above or to the side of the press chamber.

20. The device according to claim 18, wherein the mechanical drive for moving the press shield is formed by a hydraulic master-slave cylinder pair.

21. The device according to claim 1, wherein the press direction extends vertically from top to bottom or horizontally and that, in each case, the transportation direction extends perpendicularly thereto in a horizontal direction and in the direction of the edges of the partial compressed bales having the edge length C/n.

22. The device according to claim 1, wherein the press chamber has a vertically extending longitudinal direction and the press direction extends vertically from top to bottom parallel to the longitudinal direction and the storage space is arranged at the appropriate height in relation to a lower region of the press chamber.

23. The device according to claim 1, wherein the press chamber has a vertically extending longitudinal direction and the press direction extends vertically from bottom to top parallel to the longitudinal direction and the storage space is arranged at the appropriate height in relation to an upper region of the press chamber.

24. The device according to claim 1, wherein, the press chamber has a longitudinal direction that extends obliquely in relation to a vertical direction and the press direction extends obliquely from bottom to top parallel to the longitudinal direction and the storage space, while obliquely extending in a downward direction, is arranged at the appropriate height in relation to an upper region of the press chamber.

25. The device according to claim 24, wherein there is an angle a of no more than 45° between the vertical direction and the press direction of the press chamber, said press direction extending obliquely in relation to said vertical direction.

26. The device according to claim 24, wherein the storage space has a longitudinal that extends in transportation direction and perpendicularly in relation to the press direction of the press chamber.

27. The device according to claim 26, wherein a gravity transportation section for the compressed bales is arranged downstream from the storage space.

28. The device according to claim 27, wherein the gravity transportation section is formed by a slideway or roller track extending in an inclined direction.

29. The device according to claim 1, wherein said device has a charging assembly which comprises at least one rotationally drivable rotor roller equipped with transportation spikes, wherein said rotor roller is arranged upstream from or in a filler inlet of the device.

30. The device according to claim 29, wherein the charging assembly has a fill chamber arranged upstream from the rotor roller.

31. The device according to claim 30, wherein the fill chamber is formed by a box which is open at its top and has an opening towards the rotor roller on its side facing the filler inlet of the device.

32. The device according to claim 30, wherein a pressed product pieces transporting assembly is arranged in the fill chamber.

33. The device according to claim 32, wherein the transportation assembly comprises a swivel shield or a sliding shield.

34. The device according to claim 32, wherein the transportation assembly comprises a conveyor belt.

35. The device according to claim 34, wherein an end of the conveyor belt forming the transportation assembly can be adjusted in its height in relation to the charging assembly and be locked at its desired height, said end facing the charging assembly.

36. A method for operating a device for producing cuboid compressed bales having a width A, a height B and a depth C as edge lengths, from compressible pressed product pieces, wherein the device comprises a press housing having at least one press chamber and a press shield that can be moved in the press chamber in a press direction and back by means of a mechanical drive, wherein a storage space is arranged downstream from the press chamber, wherein the press chamber is separated from the storage space by a partition that can be moved between a closing position and an opening position, said partition forming at least one part of a wall of the press chamber, said part being the last one as seen in press direction, and said partition freeing an opening if it is in its opening position, comprising the steps:

producing n partial compressed bales in the press chamber, which has a cross-sectional surface of A×C/n as seen perpendicular in relation to the press direction, wherein n is greater than or equal to 2, in n first press steps, with a flat cuboid form with the edge lengths A, B and C/n, transferring each partial compressed bale formed in the press chamber after it has been produced into the storage space through the opening having at least the dimension A×B, in a transportation direction extending in parallel to the dimension C/n of the press chamber, until n partial compressed bales present in the storage space are bearing against each other with their flat sides having the edge lengths A and B, and joining the n partial compressed bales in the storage space to form the cuboid compressed bale having the edge lengths A, B and C by attaching at least one joining means which is guided in parallel to the edges having the lengths B and C.

37. The method according to claim 36, wherein the storage space is provided with limiting devices, further comprising the step of using the limiting devices in the storage space to exert a preloading force on the partial compressed bales present in said storage space, said preloading force preventing the partial compressed bales from reexpanding.

38. The method according to claim 36, wherein the storage space comprises a motion stop for a first partial compressed bale present in the storage space and wherein the stop can be moved or removed, further comprising the step of exerting a force pressing the n partial compressed bales against each other with their flat sides on an nth partial compressed bale which is the last one present in the storage space, this exerting a force being accomplished by means of the transportation assembly being moved out in transportation direction or by means of a wedge-shaped formation of the side of the partition facing the storage space with said partition being moved in closing direction.

39. The method according to claim 36, further comprising the step of removing, pushing, ejecting or dumping the compressed bale produced out of the storage space in a direction extending transversely in relation to the transportation direction of the transportation assembly.

40. The method according to claim 36, further comprising the step of removing, pushing, ejecting or dumping the compressed bale produced out of the storage space in a direction extending in the transportation direction of the transportation assembly.

* * * * *